US008424113B2

(12) United States Patent
Sprole

(10) Patent No.: US 8,424,113 B2
(45) Date of Patent: Apr. 23, 2013

(54) CONVERTIBLE SLEEP SHELL

(75) Inventor: Beth B. Sprole, Wilton, CT (US)

(73) Assignee: Hibe, LLC, Wilton, CT (US)

( * ) Notice: Subject to any disclaimer, the term of this patent is extended or adjusted under 35 U.S.C. 154(b) by 859 days.

(21) Appl. No.: 12/562,848

(22) Filed: Sep. 18, 2009

(65) Prior Publication Data

US 2011/0067163 A1 Mar. 24, 2011

(51) Int. Cl.
*A41D 13/00* (2006.01)

(52) U.S. Cl.
USPC ..... 2/69.5; 2/69

(58) Field of Classification Search ..... 2/69, 69.5, 2/85, 80, 93, 83; 5/413 R, 485, 482, 494, 5/486
See application file for complete search history.

(56) References Cited

U.S. PATENT DOCUMENTS

| | | | | | |
|---|---|---|---|---|---|
| 782,819 | A | * | 2/1905 | Bikle | 2/75 |
| 1,241,699 | A | * | 10/1917 | Hope | 128/873 |
| 1,324,009 | A | * | 12/1919 | Barnes | 5/413 R |
| 1,370,009 | A | * | 3/1921 | Ehrenberg | 128/873 |
| 1,432,249 | A | * | 10/1922 | Hoyme | 2/69 |
| 1,497,685 | A | * | 6/1924 | Hoyme | 2/67 |
| 2,244,219 | A | * | 6/1941 | Sampson | 269/211 |
| 2,478,239 | A | * | 8/1949 | Chinn | 128/873 |
| 2,644,948 | A | * | 7/1953 | Gutmann | 2/69.5 |
| 2,870,464 | A | * | 1/1959 | Lalick | 5/484 |
| 2,967,306 | A | * | 1/1961 | Fabanich | 2/94 |
| 3,381,306 | A | | 5/1968 | Innes | |
| 3,391,306 | A | * | 7/1968 | Piccione | 361/153 |
| 4,507,805 | A | | 4/1985 | Calutoiu | |
| 4,513,461 | A | * | 4/1985 | Tardivel | 5/413 R |
| 4,637,075 | A | * | 1/1987 | Ingrisano et al. | 2/94 |
| 4,876,724 | A | * | 10/1989 | Suzuki | 381/385 |
| 4,998,296 | A | * | 3/1991 | Stames | 2/458 |
| 5,131,096 | A | * | 7/1992 | Olson | 2/75 |
| 5,437,061 | A | | 8/1995 | Kenner | |
| 5,564,123 | A | * | 10/1996 | Grassick | 2/69 |
| 5,697,102 | A | * | 12/1997 | Benjamin | 2/84 |
| 5,718,000 | A | | 2/1998 | Ost et al. | |
| 6,014,772 | A | | 1/2000 | Connelly | |
| 6,105,168 | A | * | 8/2000 | Hazen | 2/69.5 |
| 6,219,847 | B1 | * | 4/2001 | Aikins | 2/69 |
| 6,330,720 | B1 | | 12/2001 | Steelman | |
| 6,367,083 | B1 | * | 4/2002 | November | 2/69.5 |
| 6,643,870 | B2 | * | 11/2003 | Bertrand | 5/482 |
| 6,839,924 | B2 | * | 1/2005 | Sims | 5/494 |
| 7,013,507 | B2 | * | 3/2006 | Cook | 5/413 R |
| 7,765,611 | B2 | * | 8/2010 | Marshall et al. | 2/88 |
| 7,832,032 | B2 | * | 11/2010 | Haislip | 5/413 R |
| 2010/0256716 | A1 | * | 10/2010 | Haislip | 607/108 |

* cited by examiner

*Primary Examiner* — Gloria Hale
(74) *Attorney, Agent, or Firm* — UCONN IP Law Clinic; Susan K. Pocchiari; Christopher Messina

(57) ABSTRACT

A sleep shell is provided comprising a flexibly foldable sheet material having complementary engageable side enclosures enabled to surround at least a user's torso. The sheet material has aligned recessed neck openings to form a neck hole when folded and at least a pair of complementary fasteners engageable with one another and disposed substantially toward the top side of the sheet material. An arm opening is also provided disposed selectively between top and bottom of the sheet material. The shell can be used for sleeping or as a blanket and allows a user to become ambulatory while wearing it.

6 Claims, 1 Drawing Sheet

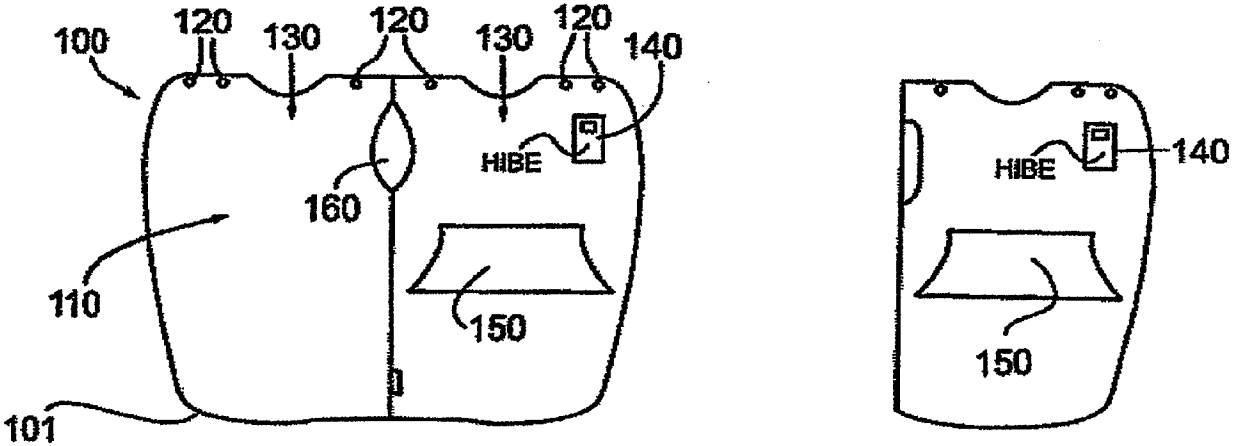
FIG. 1
FIG. 2
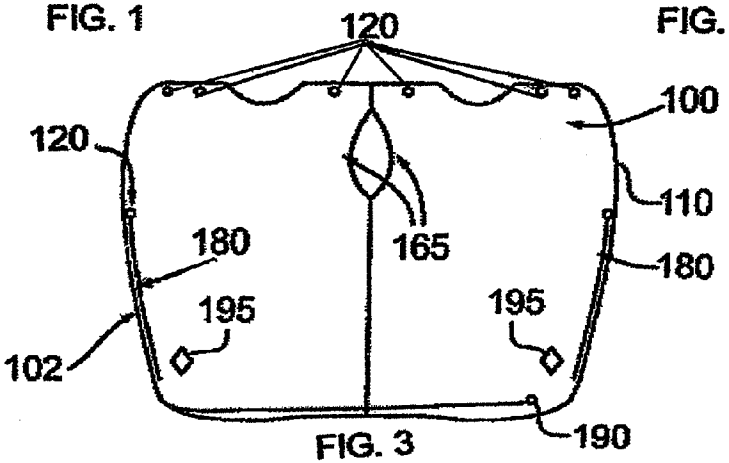
FIG. 3

CONVERTIBLE SLEEP SHELL

FIELD OF INVENTION

This invention relates to sleeping bags and blankets generally, and more particularly to an ambulatory sleep shell that can be used both as a sleeping bag and a blanket.

BACKGROUND OF THE INVENTION

Sleeping bags and wearable blankets have been used in connection with a number of applications. For example, the increasing popularity of outdoor activities such as camping have made ambulatory sleeping bags popular. In addition to outdoor use, ambulatory blankets are used indoors in environments where the user may not want or be able to adjust the room temperature to a warmer setting such as in dormitories. The key feature in construction of these sleeping bags and blankets is the ease of use, especially in enabling user movement while wearing these items. Comfort is another important aspect.

Unfortunately the sleeping bags and blankets are manufactured and sold as two separate items. The sleeping bags are often fabricated to reflect outdoor needs while the blankets are used for indoor use. The designers of these items, however, face similar challenges. In both cases, the bag or blanket must remain functional and provide its primary objective but in addition also provide comfort and ease of movement when the user becomes ambulatory.

Consequently, it is desired to manufacture a sleep shell that can be used both indoors and outdoors while allowing the user to become ambulatory. To this end, the desired sleep shell must be optimally functional both as a sleeping bag and a blanket while optimizing comfort and ease of movement for an ambulatory user.

SUMMARY OF THE INVENTION

Thus, according to various aspects of the invention, a sleep shell is provided comprising a flexibly foldable sheet material having complementary engageable side enclosures enabled to surround at least a user's torso. The sheet material has a recessed neck opening and at least a pair of complementary fasteners engageable with one another and disposed substantially toward the top side of the sheet material. An arm opening is also provided disposed selectively between top and bottom of the sheet material.

In alternate embodiments, one or more pockets are provided for warming hands and for storing objects such as electronic devices in the shell. In one embodiment, the enclosures engage to one side of a user's torso in such a way to allow the opposite arm to remain unobstructed. Additional fastening means may be provided on the bottom of the sheet material to enable a user to become ambulatory without trailing the material of the sheet or alternatively cover the user's feet completely while sleeping.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

FIG. 1 is a side view illustration of a sleep shell as per one embodiment of the present invention;

FIG. 2 is an illustration of the sleep shell of the embodiment depicted in FIG. 1 when folded; and FIG. 3 is a side view illustration of an embodiment of the present invention depicting a sleep shell with side enclosures.

DETAILED DESCRIPTION

In accordance with embodiments of the invention described herein, a convertible sleep shell is provided that can be used both for indoor and outdoor use. The sleep shell can be worn in a manner that allows the user to be ambulatory while functioning both as a sleeping bag and/or a blanket.

One embodiment of the present invention is shown in FIG. 1. The side view illustration of FIG. 1 provides for a sleep shell 100, consisting of a sheet material 110 that is flexibly foldable such that it can surround at least a user's torso, and preferably a user's torso and legs. FIG. 2 is an illustration of the sheet material 110 of the embodiment of FIG. 1 after it is folded.

FIG. 3 is a side view illustration of a preferred embodiment of the present invention. In the embodiment of FIG. 3, the sheet material 110 includes side enclosures 180, such as zippers or snaps, that are complementarily engageable with one another. In a preferred embodiment, the enclosures 180 are disposed such as to engage to one side of the user's torso. The enclosures 180 can include one type or more than one type of fastening means. For example, the enclosures can include a zipper that runs the entire length of each opposing side of the sheet 110 or stop at some point to allow a user's arm to emerge. Additional enclosures, shown as 195, can then be provided (in this example shown as a pair of snaps) to allow the shell to selectively close entirely if desired, while providing selective covering of the arm. In an alternate embodiment, the side enclosures close entirely while a side arm hole is provided separately in an adjacent area separate from where the enclosures are located (not illustrated).

Referring back to FIG. 1, additional fasteners collectively referenced as 120 are also provided substantially at the top of the sleep shell 110. These fasteners are paired up and are complementary in design such that when the sheet material 100 is folded they become engageable with one another. In FIG. 1 three pairs of snaps are provided on the top side of the sheet 110 by way of example.

The material sheet 110 is recessed on its top side, at least in one location, to allow the head and neck of the user to remain unobstructed (when the enclosures 180 are engaged). In a preferred embodiment as shown, two complementary recessed areas are shown as referenced as 130. These areas are selectively disposed at a distance from one another such as to align and form a unitarily neck hole once the enclosures 180 or fasteners 120 are engaged as shown in FIG. 2.

In addition, an arm opening 160 is also provided to allow one of the user's other arm to emerge from the arm hole while the sleep shell 100 is being worn. The arm opening 160, in one embodiment as shown in FIG. 3 can also include additional engageable snaps 165 that can close the arm opening selectively as desired such as during sleeping. The arm opening 160 is different than an arm hole previously discussed. In an embodiment in which both an arm hole and an arm opening is provided, the opening and the hole will be selectively disposed to optimize comfort.

Looking at FIGS. 1 and 3 together, the sleep shell 100 in one embodiment comprises an inside and an outside. The inside can be defined as the side adjacent to the user's body while the outside is the side facing the elements. In FIG. 1, outside 101 is illustrated while FIG. 3 illustrates the inside 102 as shown.

In one embodiment, a small inside or outside pocket, shown here by way of example as 140, can also be provided for certain items. In a preferred embodiment, the pocket is specifically designed to house one or more electronic devices, including but not limited to cell phones and MP3 players as known to those skilled in the art. The pocket can be disposed on the inside or outside of the shell once the enclosures are engaged. In alternate embodiments the pocket is enabled to receive electrical devices for example by providing additional openings to allow electrical wires/cables to traverse through. In one embodiment, the storage pocket also includes additional inside compartments to maximize storage. In other embodiments, the storage pocket may also be designed such that it can close for the wearer's security. Buttons, snaps or other components as known to those skilled in the art will be used in such a case.

In an alternate embodiment of the present invention, the shell can include one or more electrical and/or electronic devices and components to provide additional heat producing functions similar to electrical blanket and other such devices as known to those skilled in the art. If the shell will be used such that it needs to be plugged in an electrical outlet, a retractable cable such as disposed in the pocket 140 will be provided to enable ambulatory use as desired. In addition, in the case of such an embodiment, it is preferable to use materials in fabrication of the shell that are flame retardant. However, flame retardant materials for fabrication of the shell may be used in other embodiment of the present invention as well.

In other embodiments it is also possible to include an additional hand warming pocket. This pocket can be provided on the inside or outside. In the preferred embodiment of FIGS. 1 and 2, the hand warming pocket referenced as 150 is provided on the outside. In this embodiment, the hand warming pocket is larger than the storage pocket and is selectively lined to provide additional warmth and comfort to the user.

The shell 100 can be fabricated of a combination of fabrics. For example, it can be comprised of a material such as fleece intended to keep the user warm or it can also include an outer layer of impermeable material. The inside portion would include a fabric that provides comfort and warmth to the user's skin which is potentially exposed to it, while the outside portion is provided to keep the user dry when camping or in other indoor or outdoor situations, where the blanket/shell 100 can be exposed to the elements or items that could soil or stain the sleep shell. Alternatively, the shell/blanket 100 can be fabricated of a completely impermeable material outside with a filled interior layer inside to provide warmth while keeping the user also substantially dry.

Referring to FIG. 3, The sleep shell 100 can be designed to be slightly smaller than the user's body length as to allow the user to walk comfortably without falling, or it can have further fastener means 195 on the bottom portion to allow it to be adjusted to a shorter length so as to allow the user to walk comfortably. These fastening means can for example be designed to fold up or tuck in part of the fabric of the sheet material to enable this. It should also be noted that while these additional fasteners are disposed on a bottom portion of the sheet material 100 as shown in the figures, this is not a requirement and they can be located anywhere inside or outside the sheet material to achieve the same or similar function. Alternate designs can also be used as known to those skilled in the art. Same or different adjustable fasteners can also be used to allow the user's feet and legs to become completely enclosed when the user is no longer walking but sleeping in the shell 100. Alternatively, the bottom portion of the shell/blanket can use the different complementary engageable means to fully enclose and protect a user's feet and legs as shown at 190.

The shell 100 can be manufactured to be reversible. In such an instance, the enclosures and are fasteners are selectively designed to provide this ability. Additional enclosures may be disposed to enable this as well.

In alternate embodiments, the shell 100 may be fabricated as an ambulatory blanket, an ambulatory sleeping bag or as a combination ambulatory sleeping bag and blanket.

While the invention has been described in accordance with certain preferred embodiments thereof, those skilled in the art will understand the many modifications and enhancements which can be made thereto without departing from the true scope and spirit of the invention, which is limited only by the claims appended below.

What is claimed is:

1. A convertible ambulatory blanket and sleeping bag combination comprising:

a foldable sheet material having a top edge, a bottom edge, a left side edge, and a right side edge; each of the left and right side edges has a complementary side edge closure that is enabled to engage with one another such as to thereby surround a user's torso when said sheet material is folded and said right and left side edges meet one overlying the other;

a neck opening in said top edge positioned approximately in a middle of said folded sheet material after said sheet material is folded;

at least a pair of complementary fasteners engage able with one another when said sheet material is folded, wherein said complementary fasteners are disposed substantially toward said top edge of said sheet material and which align and fasten when said sheet material is folded;

at least one arm opening disposed to a side of the user's torso along the folded side edge of said folded sheet material after said sheet material has been folded which is opposite the closure side edge;

and wherein a user is ambulatory while wearing said convertible ambulatory blanket and sleeping bag combination.

2. The convertible ambulatory blanket and sleeping bag combination of claim 1, further comprising at least a pair of complementary fasteners engage able with one another when said sheet material is folded, wherein said complementary fasteners are disposed substantially toward said bottom edge of said sheet material and which align and fasten when said sheet material is folded such as to thereby enclose a user's feet.

3. The convertible ambulatory blanket and sleeping bag combination of claim 1, further comprising one or more additional fasteners to adjust said bottom edge of said sheet material such that said sheet material is not trailing when said user is ambulatory.

4. The convertible ambulatory blanket and sleeping bag combination of claim 1, further comprising a pocket.

5. The convertible ambulatory blanket and sleeping bag combination of claim 1, wherein said sheet material further comprises an inside portion and an outside portion when said sheet material is folded, and wherein said inside portion consists substantially of a fleece material and said outside portion consists substantially of a water resistant material.

6. The convertible ambulatory blanket and sleeping bag combination of claim 1, further comprising electrical components for generating heat therein to warm said user as desired.

* * * * *